US006024171A

United States Patent [19]

Montgomery et al.

[11] Patent Number: 6,024,171

[45] Date of Patent: Feb. 15, 2000

[54] METHOD FOR STIMULATING A WELLBORE PENETRATING A SOLID CARBONACEOUS SUBTERRANEAN FORMATION

[75] Inventors: Carl T. Montgomery, Plano; Walter C. Riese, Katy, both of Tex.

[73] Assignees: Vastar Resources, Inc., Houston; Atlantic Richfield Company, Plano, both of Tex.

[21] Appl. No.: 09/041,164

[22] Filed: Mar. 12, 1998

[51] Int. Cl.[7] ..... E21B 43/16

[52] U.S. Cl. ..... 166/308; 175/67; 299/17

[58] Field of Search ..... 166/308, 305.1; 175/67; 405/55; 299/16, 17

[56] References Cited

U.S. PATENT DOCUMENTS

| | | | |
|---|---|---|---|
| 2,307,729 | 1/1943 | Foster | 166/299 X |
| 2,616,370 | 11/1952 | Foster | 175/4.6 X |
| 2,837,027 | 6/1958 | Martin | 175/4.6 |
| 2,867,172 | 1/1959 | Hradel | 166/299 X |
| 2,988,143 | 6/1961 | Scotty | 166/299 |
| 3,951,457 | 4/1976 | Redford | 299/5 |
| 4,140,346 | 2/1979 | Barthel | 299/17 |
| 4,212,353 | 7/1980 | Hall | 166/303 |
| 4,437,706 | 3/1984 | Johnson | 299/7 |
| 4,534,427 | 8/1985 | Wang et al. | 175/67 |
| 4,618,298 | 10/1986 | Takamiya et al. | 405/150.1 |
| 4,728,152 | 3/1988 | Pike et al. | 299/17 |
| 5,014,788 | 5/1991 | Puri et al. | 166/308 |
| 5,249,844 | 10/1993 | Gronseth | 299/17 |
| 5,366,030 | 11/1994 | Pool, II et al. | 175/215 |
| 5,417,286 | 5/1995 | Palmer et al. | 166/308 |
| 5,853,224 | 12/1998 | Riese | 299/13 |

OTHER PUBLICATIONS

"Openhole Cavity Completions in Coalbed Methane Wells in the San Juan Basin"—I. D. Palmer, M. J. Mavor, J. P. Seidle, J. L. Spitler and R. F. Votz, SPE 24,906, Society of Petroleum Engineers, Oct. 4–7, 1992.

"The Technical Review–Perforating", vol. 34, No. 2, Jul. 1986.

"An Introduction to Perforating", C. M. Hightower, P.E., ARCO Exploration & Production Technology, undated.

*Primary Examiner*—Eileen Dunn Lillis
*Assistant Examiner*—Sunil Singh
*Attorney, Agent, or Firm*—F. Lindsey Scott

[57] ABSTRACT

A method for stimulating a wellbore penetrating a solid carbonaceous subterranean formation by positioning a hydrajet in an uncased portion of the wellbore penetrating the formation; perforating the formation with the hydrajet; and producing carbonaceous fluids and particulates from the formation through the wellbore and, thereby, forming a cavity in the formation surrounding the wellbore.

14 Claims, 5 Drawing Sheets

METHOD FOR STIMULATING A WELLBORE PENETRATING A SOLID CARBONACEOUS SUBTERRANEAN FORMATION

FIELD OF THE INVENTION

This invention relates to the stimulation of a wellbore penetrating a solid carbonaceous subterranean formation for the production of hydrocarbon gas from the formation.

BACKGROUND OF THE INVENTION

Solid carbonaceous subterranean formations such as coal formations contain significant quantities of hydrocarbon gases, usually including methane, trapped therein. These gases represent a valuable resource if they can be produced economically. Where such a formation is to be mined later, it is also beneficial from a safety standpoint to produce as much of these gases as possible before commencement of mining operations. The majority of such gas, however, is sorbed onto the carbonaceous matrix of the formation and must be desorbed from the matrix and transferred to a wellbore in order to be recovered. The rate of recovery at the wellbore typically depends on the gas flow through the solid carbonaceous subterranean formation. The gas flow rate through the formation is affected by many factors including the matrix porosity of the formation, the system of fractures within the formation and the stress within the carbonaceous matrix which makes up the formation.

An unstimulated solid carbonaceous subterranean formation has a natural system of fractures, the smaller and more common ones being referred to as cleats or collectively as a cleat system. To reach the wellbore, the methane must desorb from a sorption site within the matrix and diffuse through the matrix to the cleat system. The methane then passes through the cleat system to the wellbore.

The cleat system communicating with a production well often does not provide for an acceptable methane recovery rate. In general, solid carbonaceous formations require stimulation to enhance the recovery of methane from the formation. Various techniques have been developed to stimulate solid carbonaceous subterranean formations and thereby enhance the rate of methane recovery from these formations. These techniques typically attempt to enhance the desorbtion of methane from the carbonaceous matrix of the formation and enhance the permeability of the formation.

One example of a technique for stimulating the production of methane from a solid carbonaceous subterranean formation is to complete a production wellbore with an open-hole cavity. To do this, a wellbore is first drilled to a location above the solid carbonaceous subterranean formation. The wellbore may then be cased with the casing being cemented in place using a conventional drilling rig. A modified drilling rig is then used to drill an open hole interval within the formation. An "open-hole" interval is an interval within the solid carbonaceous subterranean formation which is not cased. The open-hole interval can be completed by various methods. One method utilizes an injection/blow down cycle to create a cavity within the open-hole interval. In this method air is injected into the open hole interval and then released rapidly through a surface valve causing a gas flow shear stress to overcome the formation strength in the wellbore wall. The procedure is repeated until a suitable cavity has been created. During the procedure a small amount of water can be added to selected air injections to reduce the potential for spontaneous combustion of the carbonaceous material in the formation and the like.

Techniques such as described above are considered to be known to the art and have been disclosed in U.S. Pat. No. 5,417,286 issued May 23, 1995 to Ian D. Palmer and Dan Yee and assigned to Amoco Corporation. This patent is hereby incorporated in its entirety by reference.

The use of such completions is further described in SPE 24906 "Open Hole Cavity Completions in Coalbed Methane Wells in the San Juan Basin", presented Oct. 4–7, 1992 by I. D. Palmer, M. J. Mavor, J. P. Seidle, J. L. Spitler and R. F. Volz.

The use of cavitated completions has been found to be much more effective than the use of cased wells perforated in the solid carbonaceous subterranean formation even when fracturing or other types of cased well completions are used. When the coal in the formation surrounding the wellbore in the uncased well has insufficient strength to resist movement of coal particles into the wellbore upon the production of fluids from the coal formation, the cavity can be formed by techniques such as discussed above. Unfortunately, in some instances, the formation of cavities is not readily accomplished by the production of fluids from the wellbore. Although the formations in such instances may not have great strength, they have sufficient strength to resist the movement of coal particles into the wellbore upon the production of fluids from the coal formation. In such instances it has been found difficult to initiate and complete the formation of cavities in the coal formations.

Since the use of cavities with such wellbores has been found to be much more effective than other techniques for the production of methane, a continuing effort has been directed to the development of an improved method for the stimulation of cavitated wellbores in such formations.

SUMMARY OF THE INVENTION

It has now been found that wellbores can be stimulated in a solid carbonaceous subterranean formation by positioning a hydrajet in an uncased portion of the wellbore penetrating the formation; perforating the formation with the hydrajet; and producing carbonaceous fluids and particulates from the formation through the wellbore and, thereby, forming a cavity in the formation surrounding the wellbore.

DESCRIPTION OF THE PREFERRED EMBODIMENTS

In the discussion of the Figures the same numbers will be used throughout to refer to the same or similar components. Further, the term "coal formation" will be used to refer to solid carbonaceous subterranean formations such as brown coal, lignite, sub-bituminous coal, bituminous coal, anthracite coal, and the like.

Figure 1:
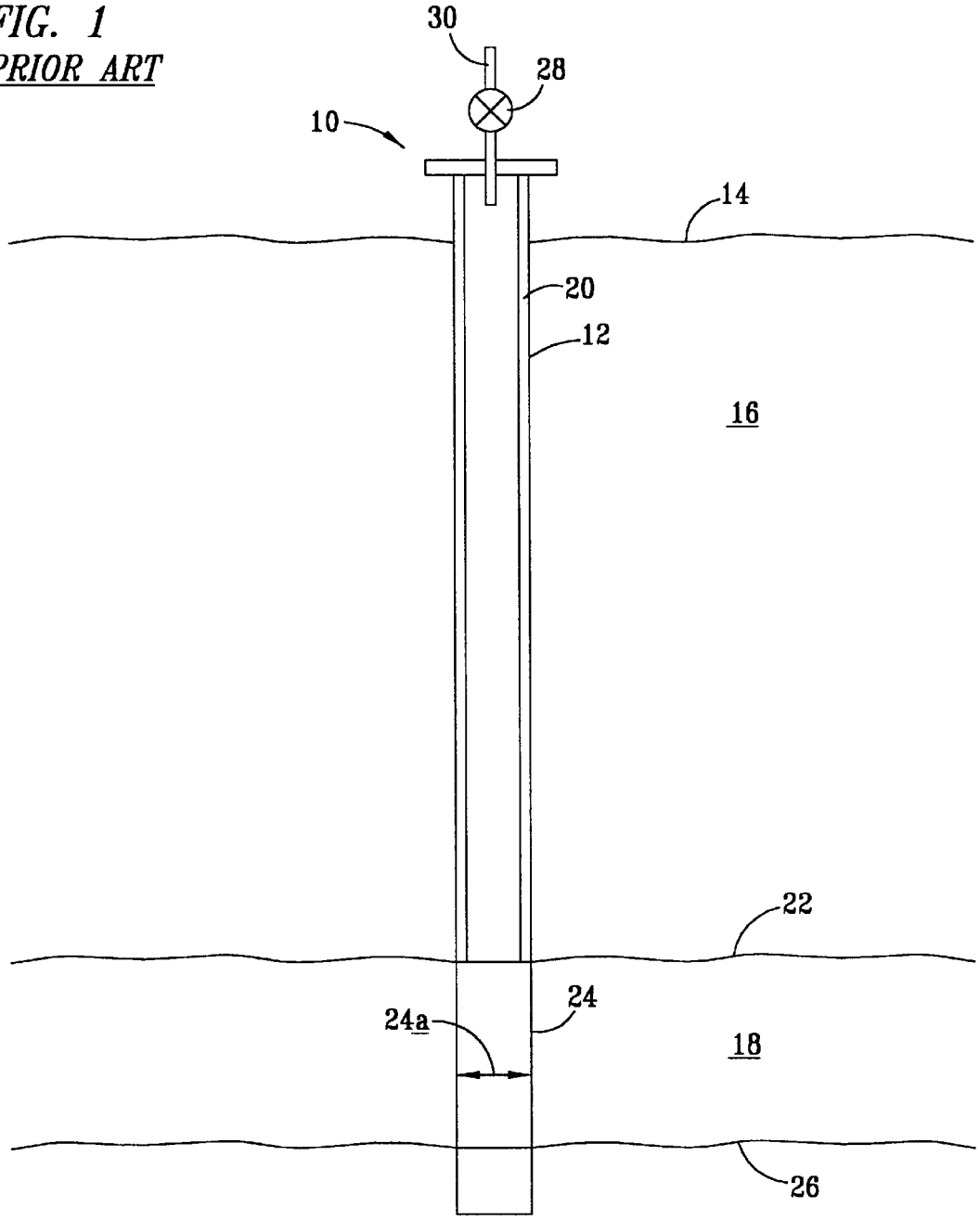
FIG. 1 PRIOR ART
FIG. 1 (Prior Art) is a schematic diagram of a well positioned to penetrate a subterranean coal formation.

In FIG. 1, a well 10 comprising a wellbore 12 extends from a surface 14 through an overburden 16 to penetrate a coal formation 18. While the wellbore 12 is depicted as extending from the surface 14 through the coal formation 18, it is not necessary that the wellbore extend through the coal formation. The well 10 includes a casing 20 which is cemented in place by techniques well known to those skilled in the art and extends from the surface 14 to a point near a top 22 of the coal formation 18. While the casing 20 is shown as extending to a point near the top 22 of the coal formation 18, the casing 20 of the well 10 may alternatively extend only to a depth necessary to enable the installation of the wellhead for the control of the flow of fluids into and out of the wellbore 12.

An uncased wellbore portion 24 of the wellbore 12 has an inside diameter 24*a* and extends through the coal formation 18 and a bottom 26 of the coal formation 18, as shown in FIG. 1. The well 10 also includes a wellhead, shown schematically as a valve 28 and a flow line 30, to control the flow of fluids into and out of the wellbore 12. Such wellheads are considered to be known to those skilled in the art and no further description is considered necessary. FIG. 1 is a typical well completion for the production of methane from a coal formation prior to any stimulation of the coal formation.

Figure 2:
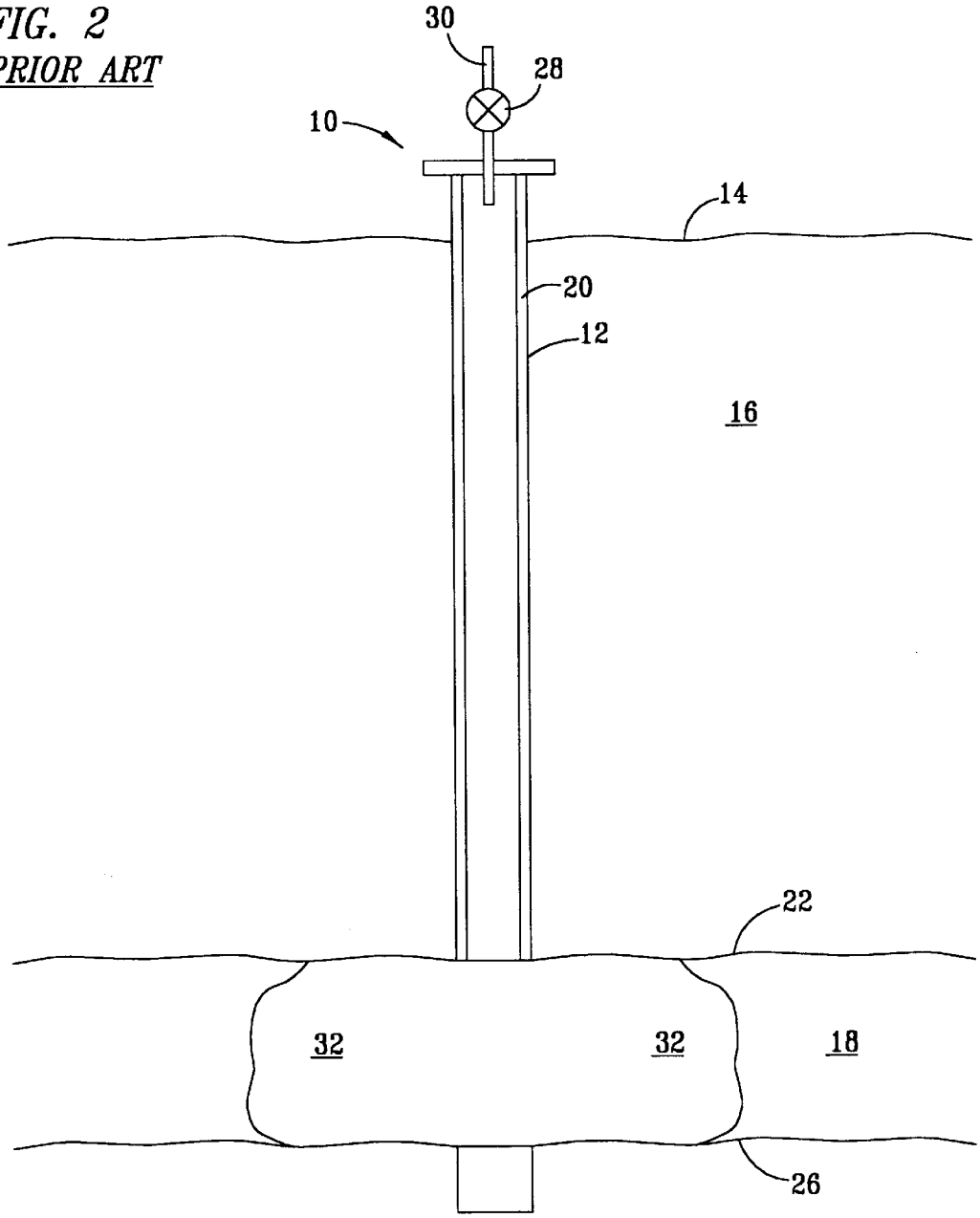
FIG. 2 PRIOR ART
FIG. 2 (Prior Art) is a schematic diagram of a well which includes a cavity formed around the wellbore in the coal formation.

In FIG. 2, the uncased wellbore portion 24 of the well 10 depicted in FIG. 1 has been stimulated to form a cavity 32 which extends outwardly from the wellbore 12 into the coal formation 18. As discussed above, cavities such as the cavity 32 may be formed by techniques such as closing in the well, allowing the pressure in the wellbore to increase to the pressure generated by the subterranean formation and, thereafter, opening the well and permitting the rapid flow of fluids and particulate coal from the coal seam 18 into the wellbore 12 and upwardly out of the wellbore. In many instances, such a treatment is sufficient to form the cavity 32. In other instances, it may be necessary to periodically pass a drill bit downwardly through the wellbore 12 to circulate and help remove particulate matter from the wellbore.

Alternatively, fluids may be injected into the well 10 until a suitable pressure is achieved in the well and thereafter allowed to flow rapidly back out of the formation 18 and the well 10 to remove particulate coal from the coal formation 18 and to form the cavity 32. Such techniques are considered to be well known to those skilled in the art.

Unfortunately, such techniques do not work in all instances because even though the coal formation may comprise relatively weak coal particles, the particles may not move into the wellbore 12 upon the production of fluids from the coal formation. This can pose considerable difficulty and result in considerable delay in forming a cavity surrounding an uncased wellbore penetrating a subterranean coal formation.

Figure 3:
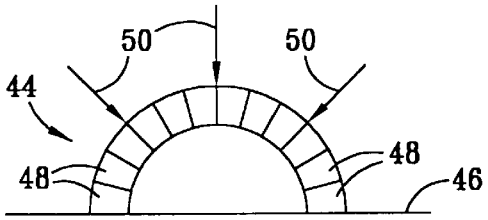
FIG. 3 PRIOR ART
FIG. 3 (Prior Art) shows an arch formed of particulate sections which is subjected to downwardly directed vertical forces.

The coal particles in such subterranean formations are generally subjected to compressive forces from three orthogonal directions. The compressive forces are imposed by the overburden 16 which imposes a vertical compressive force and horizontal forces which represent formation confining forces. With reference to FIG. 3, the effect of these forces on a given coal particle near the circumference of a wellbore can be considered by comparison to an arch structure 44 positioned on a base 46 and comprising a plurality of shaped sections 48. Such an arch has a strength which is limited only by the compressive strength of the sections 48 which make up the arch structure 44. In other words, when a load is applied in the direction of arrows 50 to the arch structure 44, the compressive strength of the arch structure is determined by the crush strength of the sections 48. The sections 48 are, thus, held in place by the imposed forces and form a structure of substantial strength.

Figure 4:
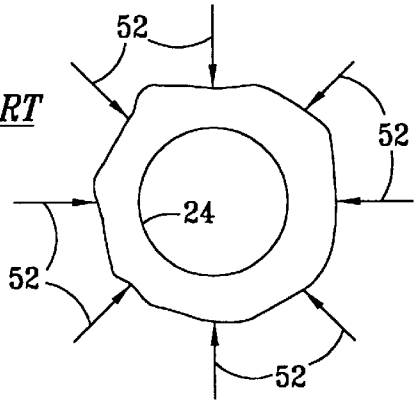
FIG. 4 PRIOR ART
FIG. 4 (Prior Art) is a cross-sectional view of a wellbore penetrating a subterranean coal formation showing horizontal forces imposed on the coal surrounding the wellbore.

By comparison, when coal and possibly other particles which make up the coal formation 18 surrounding the uncased wellbore portion 24 are subjected to horizontal forces imposed by the formation, a stable configuration similar to the foregoing arch structure 44 results. In other words, the imposed forces tend to retain the particles in place around the uncased wellbore portion 24 since the imposition of forces about the circumference of a circle results in an effect similar to that produced by the imposition of a downward force on an arch. Such an arrangement of forces is shown in FIG. 4 as horizontal forces applied in the direction of arrows 52. The imposition of such horizontal forces in the coal formation 18 on coal particles surrounding the uncased wellbore portion 24 secure the coal particles in their respective position. Unless at least a portion of the particles can be removed, a very strong structure is formed surrounding the uncased wellbore portion 24, which structure is limited only by the crush strength of the individual particles. To remove coal from such a structure requires that at least a portion of the particles be removed to initiate a collapse of the coal formation structure surrounding the uncased wellbore portion 24. This may be achieved in some wells by simply producing fluids from the formation until the formation particles are sufficiently weakened to collapse under the compressive stresses at the outer diameter of the uncased wellbore portion 24. Unfortunately, in some instances, the coal formation particles are not sufficiently weakened to collapse upon the production of fluids from the formation. As a result, such formations do not cavitate upon the production of fluids from the formation and it is difficult to form a cavity in such subterranean formations by the production of fluids from the formation as practiced previously.

It has now been found that cavitation can be initiated in uncased portions of such wells by the use of a hydrajet or other device wherein nozzles are positioned on tubing for producing water jets. Hydrajets are well known to those skilled in the art and are, for example, readily available from Halliburton Energy Services. They are typically used in the oil industry to cut wellheads for abandoned wells or for blowout control, for removing platform legs, and for cutting notches for initiating fractures in oil and gas formations. It has now been found that, in uncased portions of wells penetrating coal formations which do not readily cavitate upon the production of fluids from the formation, hydrajets can be used to initiate cavitation by forming openings, or perforations, extending outwardly from a wellbore such as the uncased wellbore portion 24 into a formation such as the formation 18. Hydrajets do not leave substantial residual material or debris in the wellbore and can form perforations extending up to at least two feet, and typically at least three feet, into the coal formation. These perforations function to create "gaps" in the circle structure of the wellbore which weaken the wall of the wellbore and permit particles to move into the wellbore with fluids produced from the formation.

Figure 5:
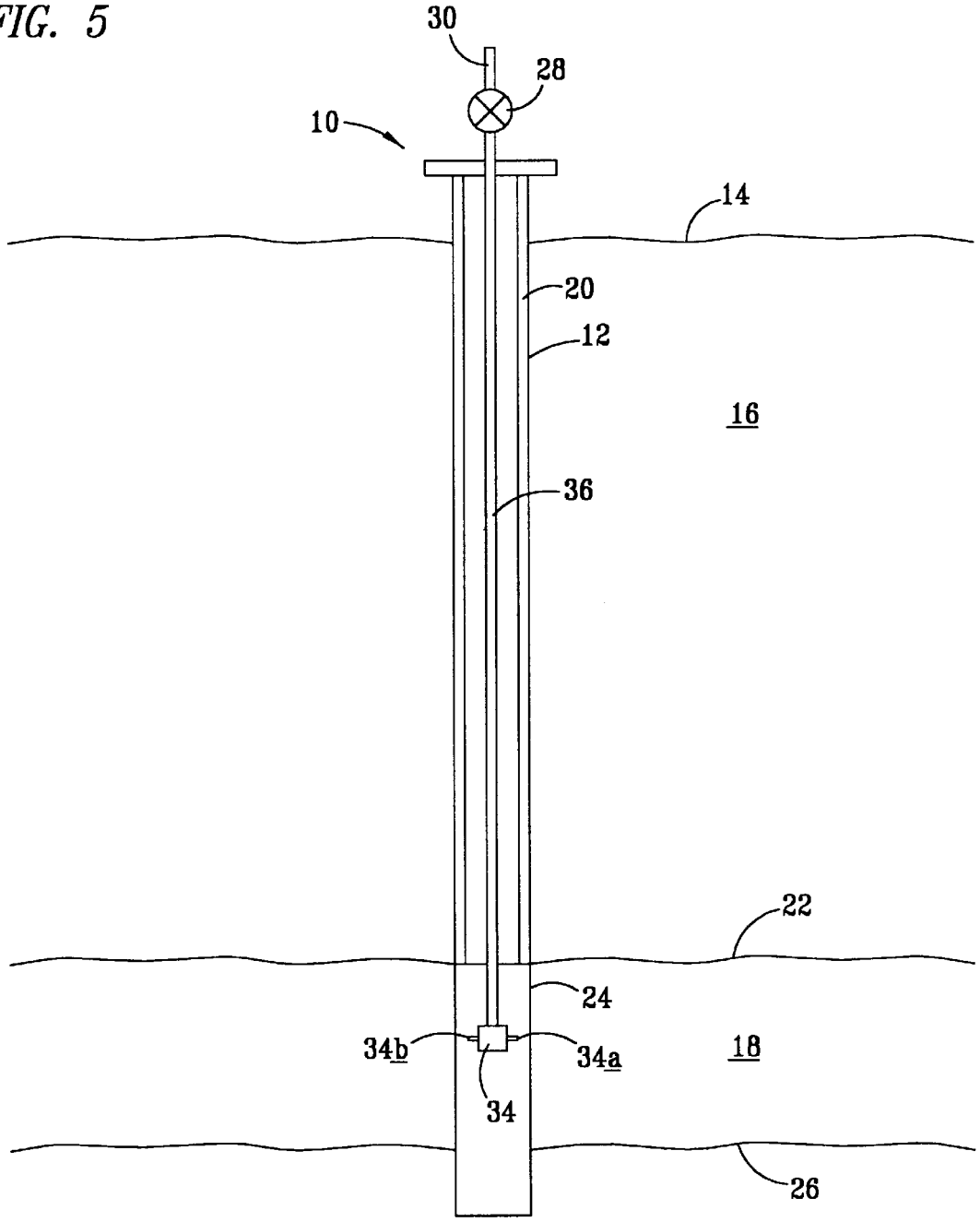
FIG. 5 is a schematic diagram of a well wherein a hydrajet has been positioned in an uncased portion of the well extending through the coal formation.

Such an embodiment is shown in FIG. 5 wherein the well 10 is shown with a hydrajet 34 positioned to form perforations along the length of the uncased wellbore portion 24 in the coal formation 18. Tubing 36, such as a workover tubing string, coiled tubing, production tubing, or the like, is positioned to extend from the valve 28 of the wellhead through the wellbore 12 to the hydrajet 34 for supplying pressurized fluid, such as water, to the hydrajet. The hydrajet 34 typically comprises two opposing carbide-hardened nozzles 34*a* and 34*b* through which the pressurized fluid is injected as a jet stream into the coal formation 18.

Figure 6:
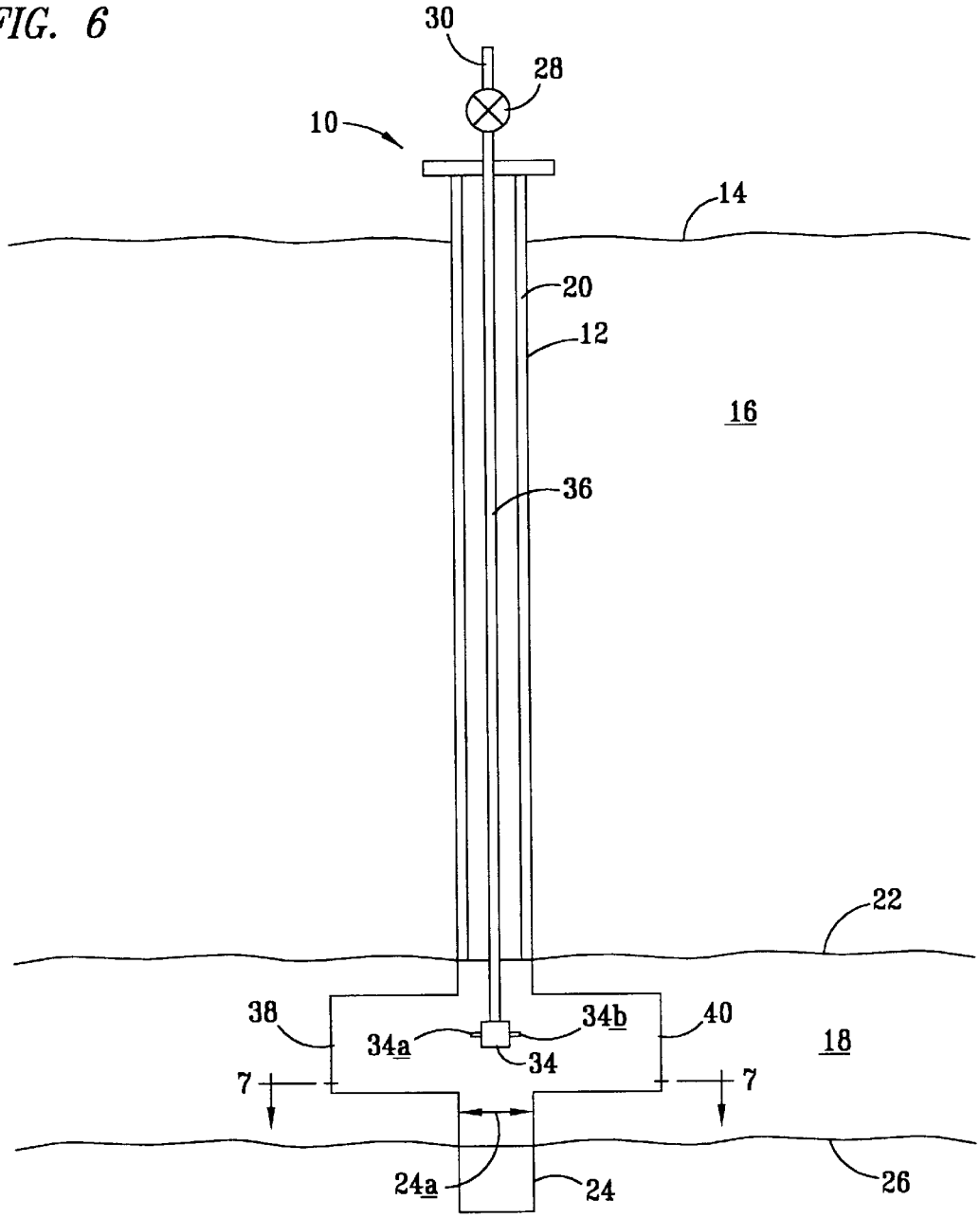
FIG. 6 is a schematic diagram of the well of FIG. 5 which has been perforated with the hydrajet.
Figure 7:
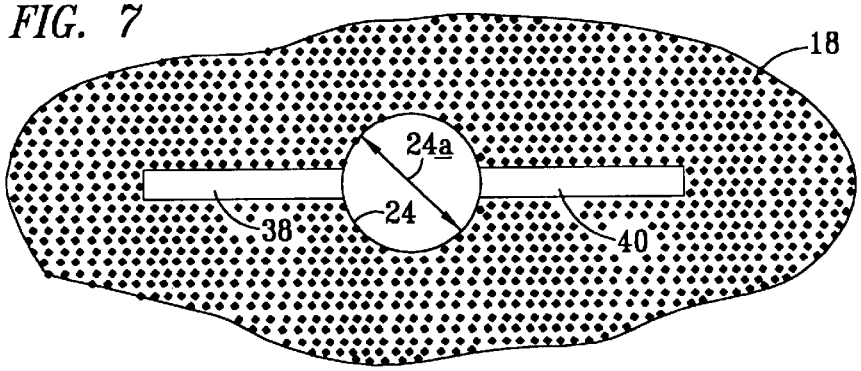
FIG. 7 is a plan view of the well of FIG. 6 taken along the line 7—7 of FIG. 6.

In the operation of the present invention, the hydrajet 34 and tubing 36 are run down the wellbore 12 until the hydrajet 34 is positioned in the uncased wellbore portion 24 as shown in FIG. 5. Fluid, such as water, chemicals, an aqueous slurry, or the like, which may optionally contain abrasive particulates, such as sand, garnet, or the like, at a pressure of from about 5,000 to about 8,000 pounds per square inch (psi) and, typically, from about 6,000 to about 7,000 psi and, preferably, about 6,500 psi, is injected into the line 30, through the valve 28 and the tubing 36 to the hydrajet 34. The pressurized fluid is then discharged through the nozzles 34*a* and 34*b* as a jet stream into the coal formation 18 as the hydrajet 34 is raised and lowered in the uncased wellbore portion 24 to form two opposing vertical perforations 38 and 40 in the formation 18, as shown in FIG. 6. FIG. 7 shows a plan view, taken along the line 7—7 of FIG. 6, of the two opposing vertical perforations 38 and 40 which may extend into the formation 18 from about 0.5 to about to about 3 wellbore diameters 24*a* and, typically, from about 1 to about 2 wellbore diameters 24*a* and, preferably, about 1.5 wellbore diameters 24*a*. While only two opposing perforations 38 and 40 are described and shown herein, additional perforations may be formed if desired to further weaken the formation 18.

After the formation 18 has been suitably perforated with the hydrajet 34, the hydrajet 34 and the tubing 36 may be removed from the wellbore 12 and the uncased wellbore portion 24 may be cavitated, as previously discussed, simply by closing the well 10 and allowing pressure to build to a selected pressure or to the maximum pressure resulting from the natural formation pressure, and then opening the well and allowing it to rapidly blow down to a selected pressure or a steady state pressure. Alternatively, the uncased wellbore portion 24 may be cavitated by closing the well 10 and pressurizing it by injecting gas or a mixture of gas and liquids (such as liquid $CO_2$) into the wellbore 12 and uncased wellbore portion 24 until a desired pressure is achieved, and then opening the well 10 and allowing it to rapidly blow down to a selected pressure or a steady state pressure. As the well 10 is blown down, fluids from the coal formation typically cause liquids, gases, and coal particulates to flow up the wellbore 12 for production. Such techniques may be repeated to produce cavities, such as the cavity 32 shown in FIG. 2, of a desired size. The uncased wellbore portion 24 may also be reentered with a drill bit in a manner well known in the art to remove particulate coal solids from the uncased wellbore portion 24 one or more times during the course of the formation of the cavity 32.

Figure 8:
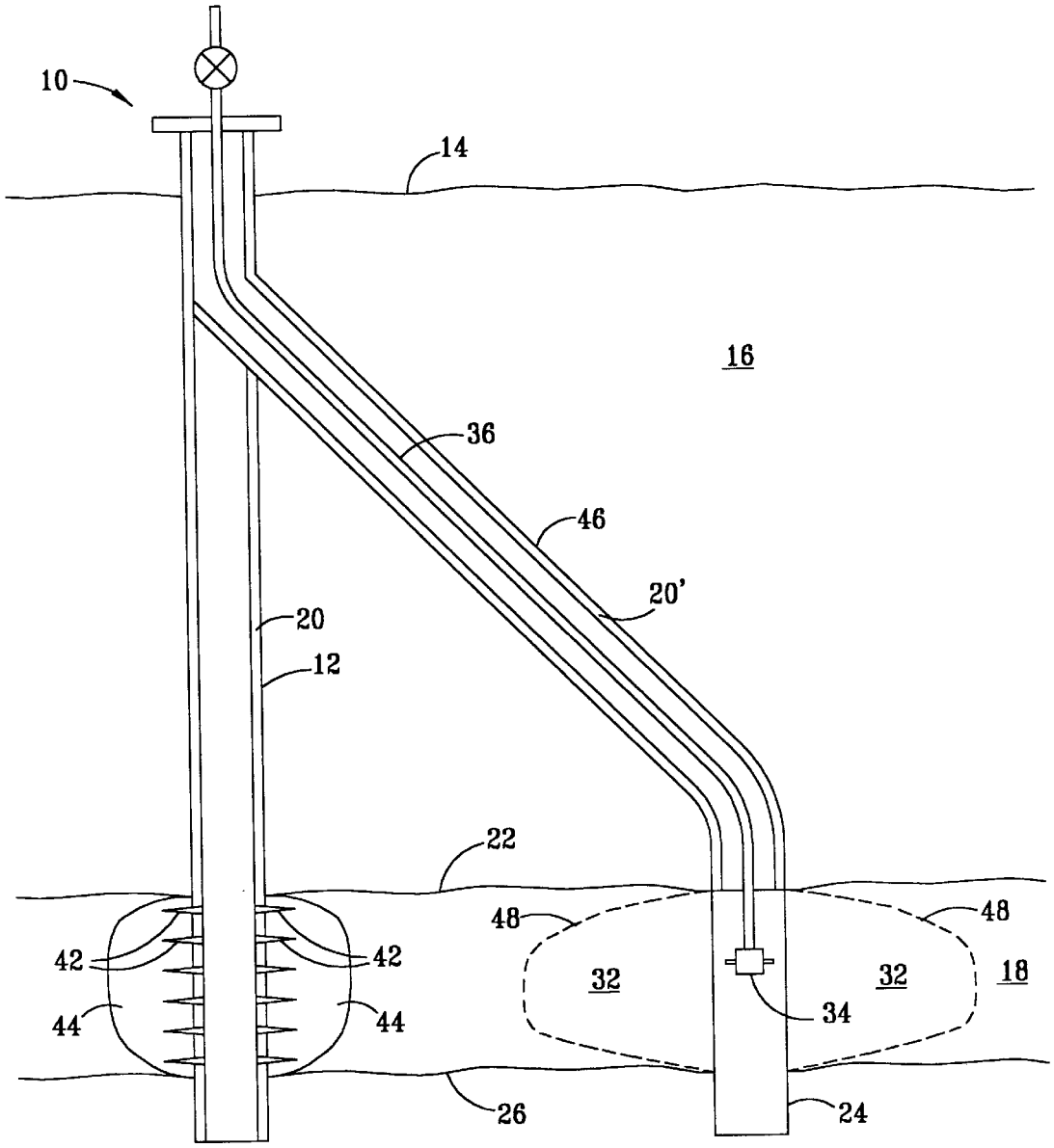
FIG. 8 is a schematic diagram of a well which has been cased through a coal seam and subsequently perforated and fractured, and which has been sidetracked to penetrate the coal formation at a different location.

In a further embodiment shown in FIG. 8, the wellbore 12 has been cased through a coal formation, perforated, and fractured. The wellbore 12 as initially completed was perforated at perforations 42 and fractured to create a fracture zone 44 in the coal formation 18. This well was then abandoned and sidetracked by drilling a sidetracked wellbore 46 as known to those skilled in the art to penetrate the coal formation 18 at a second location. A casing 20' extends to the top 22 of the coal formation 18 in the sidetracked wellbore 46. A hydrajet 34 is shown positioned in an uncased wellbore portion 24 of the sidetracked wellbore 46 to perforate the coal formation 18 in the uncased wellbore portion 24. After perforation, fluids will be produced from the coal formation 18 in a repeating cycle as discussed previously to form a cavity 32 defined by dotted lines 48.

By the method of the present invention, cavitation is induced in wells which do not cavitate using conventional methods. By the present invention, a simple method has been provided for initiating cavitation in wells which are resistant to cavitation. This improvement permits the cavitation of wells for the production of increased quantities of methane, economically and efficiently, using equipment which is readily available to the industry.

Having thus described the present invention by reference to its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for stimulating a wellbore penetrating a methane-containing carbonaceous subterranean formation having a natural system of fractures to increase the production of methane from the formation, the method comprising:

a) positioning a hydrajet in an uncased portion of the wellbore penetrating the formation;

b) perforating the formation with the hydrajet;

c) removing the hydrajet from the wellbore;

d) thereafter producing carbonaceous fluids and particulates from the formation through the wellbore by the steps of shutting the wellbore for a shut-in period to permit the pressure in the wellbore to increase and, thereafter, opening the wellbore for a production period to permit a flow of fluids and particulates from the formation into, upwardly, through and out of the wellbore and repeating the steps of shutting and opening the wellbore to form a cavity in the formation around the wellbore;

e) producing methane from the formation via the wellbore and the cavity at an increased rate.

2. The method of claim 1 wherein the step of perforating is performed by discharging a stream of fluid from a hydrajet into the formation.

3. The method of claim 2 wherein the fluid is selected from the group consisting of water, chemicals, and an aqueous slurry.

4. The method of claim 2 wherein the fluid comprises abrasive particulates.

5. The method of claim 4 wherein the abrasive particulates are selected from the group consisting of sand and garnet.

6. The method of claim 2 wherein the fluid comprises water and abrasive particulates.

7. The method of claim 2 wherein the step of perforating further comprises pressurizing the fluid to a pressure of about 5,000 to about 8,000 psi.

8. The method of claim 1 wherein the step of perforating further comprises supplying pressurized fluid to the hydrajet through one of a workover tubing string, coiled tubing, and production tubing.

9. The method of claim 1 further comprising the step of casing the wellbore from a surface to a point near the top of the formation.

10. The method of claim 1 wherein the step of perforating further comprises perforating the formation with the hydrajet at a plurality of locations.

11. The method of claim 1 wherein the step of producing further comprises permitting the flow of fluids to move the particulates into the wellbore.

12. The method of claim 1 wherein the wellbore defines a diameter and the step of perforating comprises perforating the formation with the hydrajet to a depth of about 0.5 to about 3 times the wellbore diameter.

13. A method for stimulating a wellbore penetrating a methane-containing carbonaceous subterranean formation having a natural system of fractures to increase the production of methane from the formation, the method comprising:

a) positioning a hydrajet in an uncased portion of the wellbore penetrating the formation;

b) perforating the formation with the hydrajet;

c) removing the hydrajet from the wellbore and closing the wellbore;

d) thereafter producing carbonaceous fluids and particulates from the formation through the wellbore by injecting a fluid into the formation during an injection period to increase the pressure in the formation around the wellbore and, thereafter, opening the wellbore for a production period to permit a flow of fluids and particulates from the formation into, upwardly through, and out of the wellbore to form a cavity in the formation around the wellbore;

e) producing methane from the formation via the wellbore and the cavity at an increased rate.

14. The method of claim 13, wherein the step of producing further comprises permitting the flow of fluids to move the particulates into the wellbore.

* * * * *